US008201845B2

(12) United States Patent
Girard et al.

(10) Patent No.: US 8,201,845 B2
(45) Date of Patent: Jun. 19, 2012

(54) ASSEMBLY INCLUDING A DEVICE FOR REMOVABLY AFFIXING A BASE TO A PLATE

(75) Inventors: François Girard, Veyrier du Lac (FR); Eddy Yelovina, Seynod (FR)

(73) Assignee: Salomon S.A.S., Metz-Tessy (FR)

( * ) Notice: Subject to any disclaimer, the term of this patent is extended or adjusted under 35 U.S.C. 154(b) by 866 days.

(21) Appl. No.: 12/029,652

(22) Filed: Feb. 12, 2008

(65) Prior Publication Data

US 2008/0191450 A1 Aug. 14, 2008

(30) Foreign Application Priority Data

Feb. 13, 2007 (FR) ..... 07 01036

(51) Int. Cl.
*A63C 9/00* (2006.01)

(52) U.S. Cl. ..... 280/617; 280/615; 280/618

(58) Field of Classification Search ..... 280/611, 280/613, 615, 617, 618, 633
See application file for complete search history.

(56) References Cited

U.S. PATENT DOCUMENTS

| | | | | |
|---|---|---|---|---|
| 3,977,688 | A * | 8/1976 | Imagawa | 280/633 |
| 5,211,419 | A | 5/1993 | Gorliez et al. | |
| 5,664,797 | A * | 9/1997 | Haughlin | 280/615 |
| 6,840,531 | B2 * | 1/2005 | Gorza et al. | 280/617 |
| 2006/0145452 | A1 | 7/2006 | Bjertnaes | |
| 2007/0138765 | A1 | 6/2007 | Miette et al. | |
| 2007/0228695 | A1 | 10/2007 | Miette | |

FOREIGN PATENT DOCUMENTS

| | | | |
|---|---|---|---|
| DE | 637 044 | C | 10/1936 |
| EP | 1 839 713 | A1 | 10/2007 |
| FR | 2 736 842 | A1 | 1/1997 |
| FR | 2 894 836 | A1 | 6/2007 |
| WO | WO-88/04563 | A1 | 6/1988 |
| WO | WO-2004/045728 | A2 | 6/2004 |

* cited by examiner

*Primary Examiner* — Katy M Ebner

(74) *Attorney, Agent, or Firm* — Greenblum & Bernstein, P.L.C.

(57) ABSTRACT

An assembly including a plate, a base, and a device for removably attaching the plate to the base. The plate is adapted to be associated with a device for removably retaining a boot, the base is adapted to be associated with a gliding board, such as a ski, the device for removably attaching the plate to the base including an arrangement for longitudinally guiding the plate with respect to the base. An immobilization mechanism is manually actuated to immobilize the plate with respect to the base along the longitudinal guiding direction.

28 Claims, 5 Drawing Sheets

ASSEMBLY INCLUDING A DEVICE FOR REMOVABLY AFFIXING A BASE TO A PLATE

CROSS-REFERENCE TO RELATED APPLICATION

This application claims priority under 35 U.S.C. §119 of French Patent Application No. 07 01036, filed on Feb. 13, 2007, the disclosure of which is hereby incorporated by reference thereto in its entirety.

BACKGROUND OF THE INVENTION

1. Field of the Invention

The invention relates to the field of assemblies that include a device for removably affixing a plate to a base. More specifically, the invention relates to a device for affixing a device for retaining a boot on a gliding board. In a particular embodiment, the invention relates to a device for affixing a binding to a ski, such as for cross-country skiing.

2. Description of Background and Other Information

Devices of the aforementioned type are used to practice sports, such as cross-country skiing, telemark skiing, ski touring, or the like.

It is known to associate a plate with a boot-retaining device, such as a binding, and to associate a base with a gliding board, such as a ski. From there, the plate and the base can be removably affixed to one another by a guiding arrangement, in order to affix the retaining device to the board.

For example, the patent documents FR 2 894 836 and US 2007/0138765, the disclosure of the latter document herewith being incorporated by reference thereto in its entirety, disclose a guiding arrangement used in the technical field of cross-country skiing. According to this document, the guiding arrangement includes a guide plate to longitudinally guide the plate in position relative to the base. Once the plate is mounted on the base, it suffices to immobilize it longitudinally so that both are stably attached to one another. According to the aforementioned documents, such attachment is obtained by using screws which, of course, are actuated by means of a tool. In other words, a tool is necessary to assemble and disassemble the plate and the base.

The use of a tool constitutes a constraint in many respects. One must first select the tool, which involves storing it and, when needed, locating it. This requires time and space. Next, one must manipulate the tool, which is not always simple or easy. Indeed, the screw head can be clogged with dirt, thereby hindering the cooperation with the tool. For example, dirt or ice can at least partially clog a cavity of the screw head, making it difficult to position the wrench or the screwdriver. Added, for example, is the risk of losing a screw which, when dropped in the snow, is difficult to locate.

Understandably, the use of a tool to immobilize the plate with respect to the base poses a real problem.

SUMMARY OF THE INVENTION

In view of the above, the invention avoids the use of a tool to assemble or disassemble the plate with respect to the base. In addition, the invention makes it easier to immobilize the plate with respect to the base. In particular, the invention provides an easier and quicker way to affix the plate and the base to one another.

Still further, the invention avoids the disadvantage of losing screws.

To this end, the invention proposes an assembly that includes a plate, a base, and an attachment device for removably affixing the plate with respect to the base, the plate being provided to be associated with a device for removably retaining a boot, the base being provided to be associated with a gliding board, the removable affixation device including an arrangement for longitudinally guiding the plate into position with respect to the base.

The assembly according the invention includes a manually actuated immobilization mechanism for immobilizing the plate with respect to the base along the longitudinal guiding direction.

The immobilization mechanism prevents any movement of the plate with respect to the base. Because the mechanism is positioned or actuated by hand, there is no need to use a tool, i.e., the mechanism is tool-less. In other words, it is not necessary to use an element that is not part of the attachment device to obtain the desired result, i.e., to immobilize the plate with respect to the base.

As a result, the time required to assemble or separate the plate with respect to the base is advantageously reduced. Moreover, manipulating the immobilization mechanism is easier than using a tool. Consequently, the attachment or separation of the plate with respect to the base is simple. Another advantage is avoiding the possibility of losing a screw, at least in the case of a screw actuated by means of a tool.

BRIEF DESCRIPTION OF DRAWINGS

Other characteristics and advantages of the invention will be better understood by means of the description that follows, with reference to the annexed drawings showing, according to a non-limiting embodiment, how the invention can be implemented, and in which.

DETAILED DESCRIPTION OF THE INVENTION

Although the embodiment described hereinafter relates to a cross-country ski assembly, it is to be understood that it also applies to assemblies adapted to other fields as mentioned hereinabove.

The embodiment is illustrated in FIGS. 1 to 6.

Figure 1:
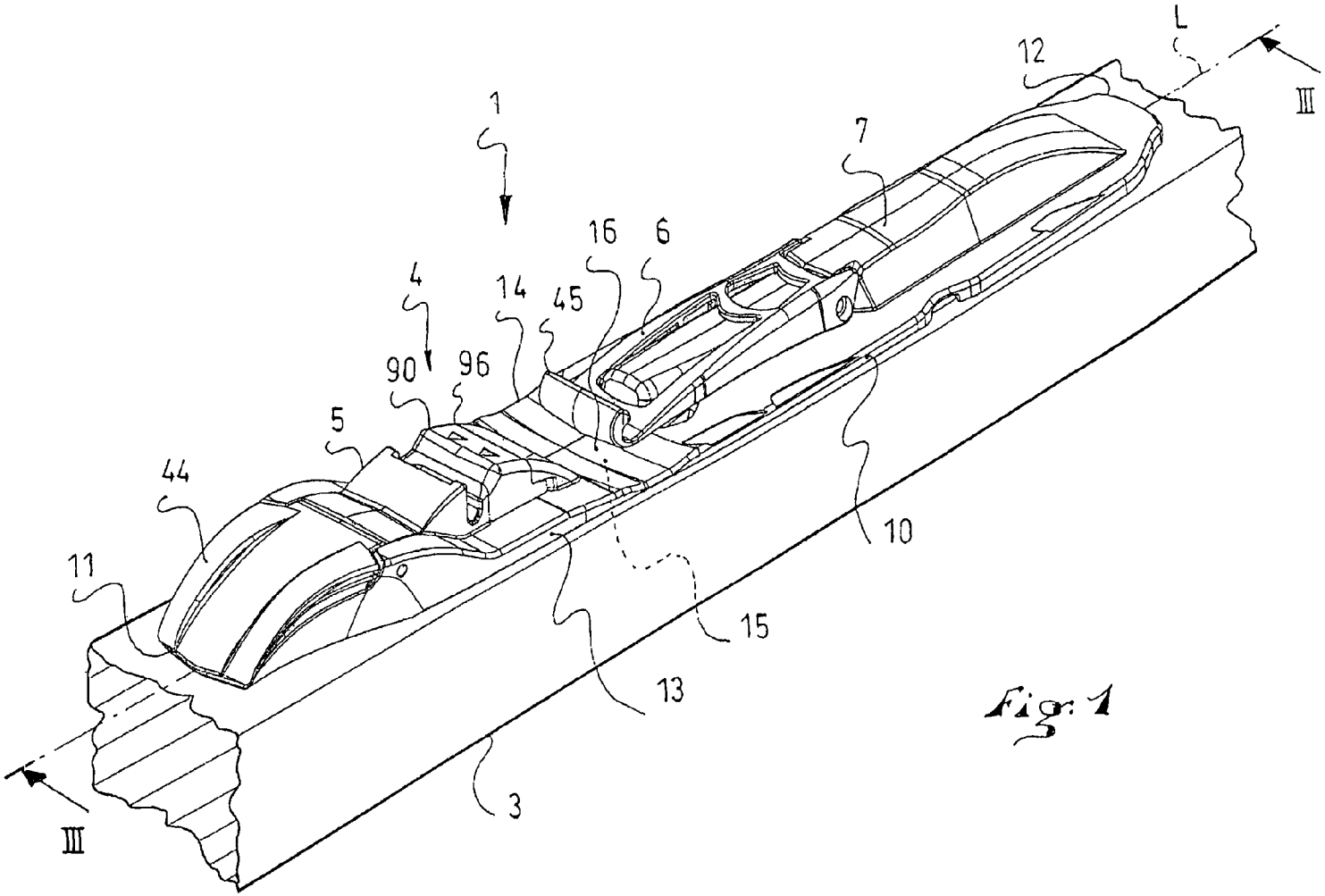
FIG. 1 is a perspective view of a device for retaining a boot on a gliding board, for an assembly according to the described embodiment of the invention, the retaining device being associated with a plate.
Figure 2:
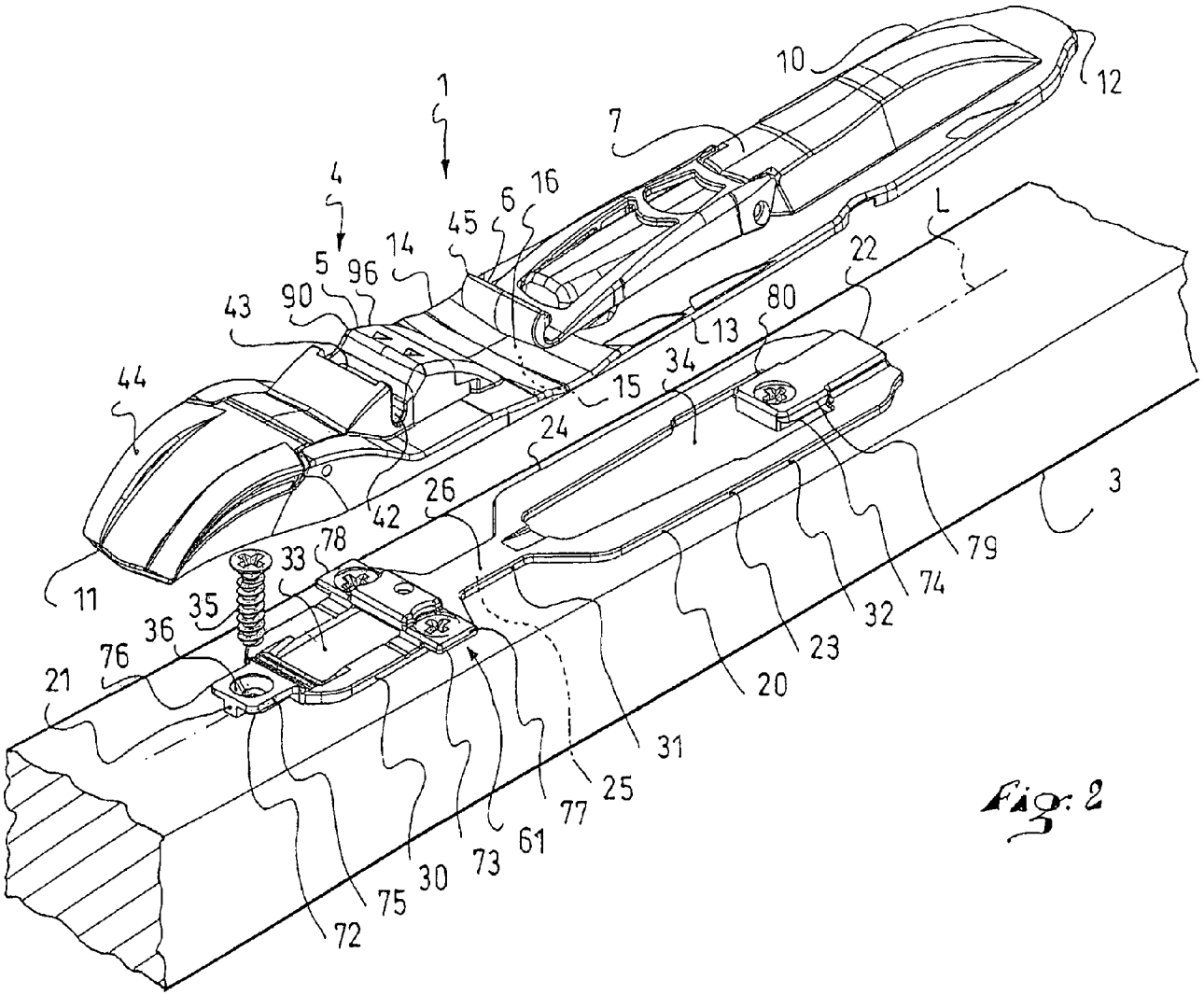
FIG. 2 is a perspective view of the retaining device of FIG. 1, as well as of a base provided to cooperate with the plate.
Figure 3:
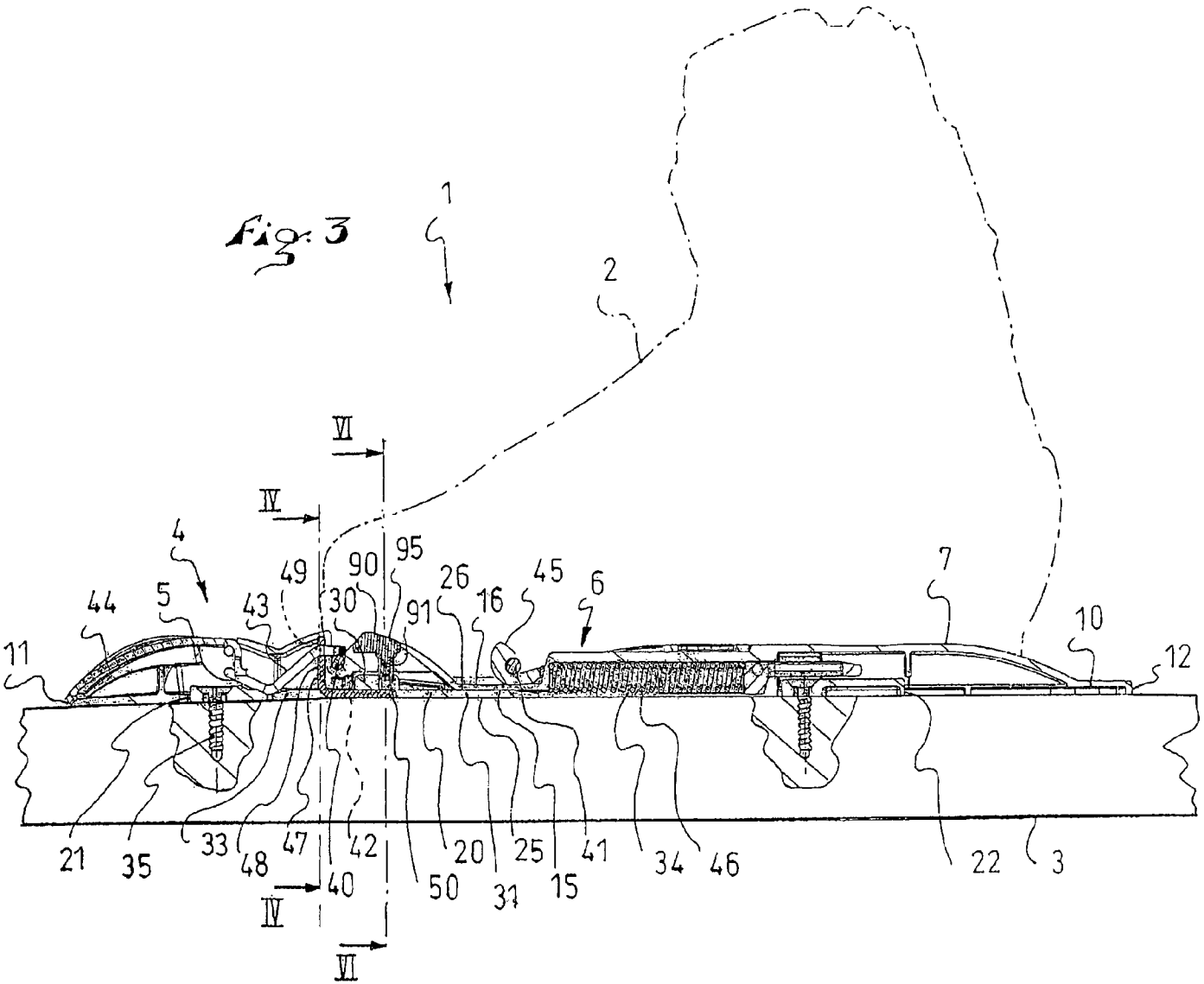
FIG. 3 is a cross section along the line III-III of FIG. 1.

As can be understood by means of FIGS. 1-3, an assembly 1 enables a boot 2 to be retained on a gliding board 3 by means of a removable retaining device 4.

The boot 2 is schematically shown in phantom lines in FIG. 3. The board 3, i.e., the ski in the illustrated embodiment, of FIG. 1 is only partially illustrated in the drawing figures. The illustrated board 3 is a cross-country ski adapted for cross-country skiing. Such skiing involves steering the ski 3 with movements that include successive acts of lifting and lowering the heel of the boot.

The device 4 for retaining the boot 2 is any of such devices that are known to one having ordinary skill in the art.

According to the embodiment illustrated and described herein, and in a non-limiting manner, the device 4 includes a reversible locking mechanism 5 and an elastic return mechanism 6. A guiding ridge 7, or rib, is also provided to enable the boot to be transversely retained. This is especially true when the heel is pressed flat on the rib.

The assembly 1 further includes a plate 10 provided to be associated with the retaining device 4. The plate 10 carries the locking mechanism 5, the return mechanism 6, and the rib 7.

According to the embodiment illustrated and described, the locking mechanism 5, the return mechanism 6, the rib 7, and the plate 10 form a unitary element, a single unit, that is, a single pre-assembled subassembly which, as such a unit—or subassembly—positioning it on the ski 3 is facilitated, as will be explained hereinafter. It could be said that the retaining device 4, the rib 7, and the plate 10 form a unitary element or subassembly.

However, one could instead provide that the mechanism 5, the mechanism 6, the rib 7, or even that all of the components 5, 6, 7, are to be attached or affixed to the plate 10 by any means.

The plate 10 extends lengthwise along a longitudinal direction L, between a first end 11, or front end, and a second end 12, or rear end.

The plate 10 extends transversely between a first side 13 and a second side 14, and height-wise from a support surface 15 up to a receiving surface 16. The support surface 15 is provided to face the ski 3, whereas the receiving surface 16 is provided to receive or face the boot 2.

The longitudinal direction L of the plate 10 merges with that of the ski, when the plate 10 is affixed/attached to the ski. Consequently, the guiding rib 7 is oriented along the length of the ski, as well as along the length of the boot.

In addition, a single plate 10 carrying a single retaining device 4, or binding, is fastened to the ski 3. This means that a single boot is retained on the ski 3.

The width of the plate 10, measured between the sides 13, 14, is substantially equal to that of the ski 3. Alternatively, the width can be different, such as, e.g., slightly greater or slightly less, the difference being a few millimeters.

As can be understood by means of FIG. 2, the assembly 1 also includes a base 20 provided to be associated with the ski 3. Similar to the plate 10, the base 20 extends lengthwise along the longitudinal direction L, between a first end 21, or front end, and a second end 22, or rear end. The base 20 extends transversely between a first side 23 and a second side 24, and height-wise from a support surface 25 up to a receiving surface 26. The support surface 25 is provided to be associated with the ski 3, whereas the receiving surface 26 is provided to receive the plate 10.

From the first end 21 to the second end 22, the base 20 successively has a first widened portion 30, a bridge 31, and then a second widened portion 32. The bridge 31 connects the portions 30, 32 to one another. In a non-limiting manner, the first widened portion 30 demarcates a central cavity 33, and the second widened portion 32 demarcates a central cavity 34. It will be seen hereinafter that the cavities 33, 34 receive elements of the plate 10 or of the retaining device 4.

A removable attachment arrangement, including four screws 35, for example, is provided to associate the base 20 with the ski 3. One could provide a different number of screws. In a non-limiting manner, one screw 35 is arranged toward the first end 21, two screws are arranged in the area of the first widened portion 30, in the vicinity of the bridge 31, and one screw is arranged in the area of the second widened portion 32, more precisely toward the second end 22. However, other arrangements are suitable.

It is to be understood that the screws 35 are screwed into the ski 3 through holes 36 of the base 20. The screws 35 and, therefore, the base 20, are provided to remain fixed to the ski.

In fact, the arrangement for attaching the base 20 to the ski 3 can be provided so as not to be removable, or at least not easily removable. For example, the base 20 could be glued or welded to the ski. The ski 3 could also form a unitary element with the base 20. Thus, the base is adapted to remain fixed to the ski independent of the plate 10 and the single unit or subassembly of which the plate 10 is a part, which unit or subassembly can be conveniently removed from the base, and from the ski, and then conveniently reattached to the base, and to the ski.

The device for affixing the plate 10 to the base 20 is described in detail further below. Nevertheless, when the plate 10 is affixed to the base 20, as seen in FIG. 3, the retaining device 4 and guiding rib 7 are removably affixed to the ski 3.

As is well known to one having ordinary skill in the art, the boot 2 includes a first connecting pin 40 and a second connecting pin 41. The pins 40, 41 are transversely arranged, in the area of the boot sole, and they can be permanently affixed therein, such as being molded to the sole during manufacture.

The first pin 40, located toward the front of the boot, is to be housed in a cavity 42 of the locking mechanism 5. The pin is removably retained in the cavity 42 by a retaining member 43. The retaining member includes a rigid wire that is actuated by a lever 44.

The second pin 41 is also located toward the front of the boot, although it is further set back. The pin 41 cooperates with the elastic return mechanism 6 to assist with the return of the sole of the boot toward the plate 11, following a lifting of the heel. For example, the second pin 41 is pulled by a hook 45 by means of the action of the elastic member 46. By way of example, as shown, the elastic member includes a spring.

Therefore, the boot 2 is retained on the plate 10 and, therefore, on the ski 3, at two points defined by the pins 40, 41. However, a different number of retaining points, for example one or three, could alternatively be provided.

Figure 4:
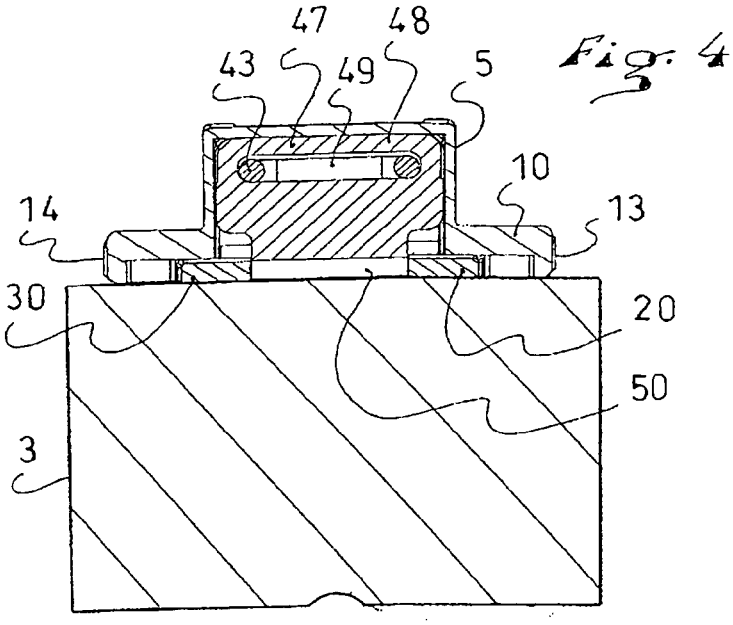
FIG. 4 is a cross section along the line IV-IV of FIG. 3.

The locking mechanism 5 is structured for a direct transmission of the steering forces, from the first pin 40 to the ski 3, as can be understood by means of FIGS. 3 and 4. Indeed, a transmitter 47 connects the retaining member 43 of the pin 40 to the ski 3. The transmitter 47 includes an angle bracket 48 traversed by a slot 49 for the passage of the wire of the retaining member 43. The base 50 of the angle bracket is pressed on the ski 3 due to the screws 35, in the area of the first portion 30 of the base 20. The base 20 is indeed structured to receive the base 50 in its first cavity 33, in the area of the two holes 36 for receiving the screws 35. Given that the wire of the retaining member 43 takes support on the pin 40 due to the transmitter 47, the steering forces are transmitted directly from the boot to the ski. As a result, the transmission of sensory information, or of the steering forces, is advantageously more precise.

Figure 5:
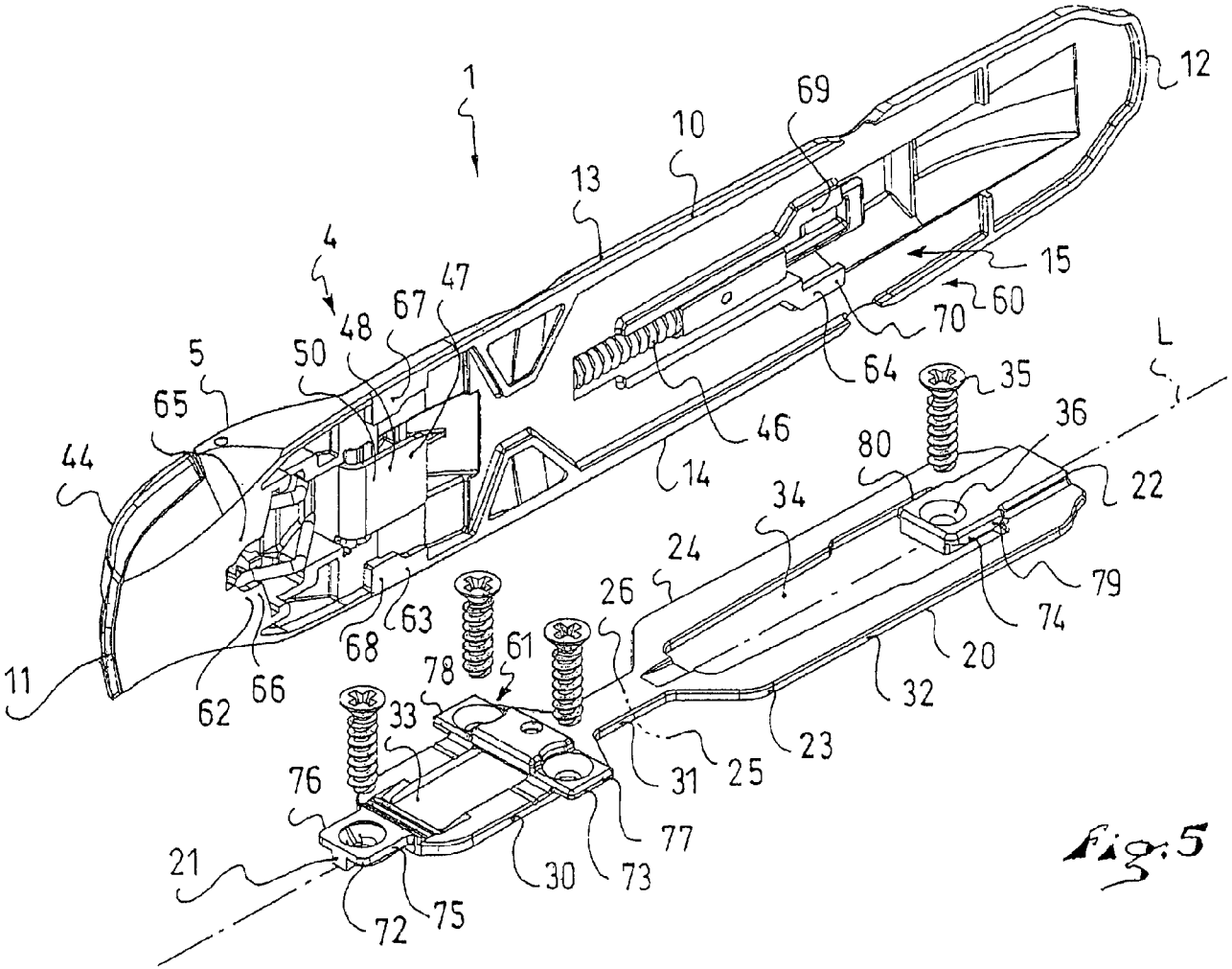
FIG. 5 is a perspective view, similar to FIG. 2, for which the retaining device and the plate are presented with a 90° angular offset.

The device for attaching the plate 10 to the base 20 is described hereinafter with reference to FIG. 5.

According to the embodiment described and illustrated, this device includes an arrangement for longitudinally guiding the plate 10 with respect to the base 20. The guiding arrangement itself includes a guide rail 60 provided on the plate 10, as well as a rail 61 provided on the base 20. The rail 61 is structured to cooperate with the guide rail 60.

In a non-limiting manner, the guide rail 60 is a segmented guide rail, i.e., one having a plurality of sections. For example, the guide rail 60, between the first end 11 and the second end 12, includes a first section 62, a second section 63, and a third section 64. The first section 62 is transversely demarcated by two edges 65, 66 turned toward one another. Similarly, the second section 63 is transversely demarcated by two edges 67, 68, and the third section 64 is transversely demarcated by two edges 69, 70. The widths of the sections 62, 63, 64 vary. Thus, the first section 62 and the third section 64 are relatively narrow, whereas the second section 63 is wider.

Consequently, a segmented rail 61, which also includes a plurality of sections, is provided. For example, the rail 61, between the first end 21 and the second end 22, includes a first section 72, a second section 73, and a third section 74. The first section 72 is transversely demarcated by two wings 75, 76 opposite one another. Similarly, the second section 73 is transversely demarcated by two wings 77, 78, and the third section 74 is transversely demarcated by two wings 79, 80. The widths of the sections 72, 73, 74 vary. Thus, the first 72 and third 74 sections are relatively narrow, whereas the second section 73 is wider.

An inverse arrangement could have been provided. A guide rail could have been arranged on the base 20, and a rail on the plate 10.

Attaching the plate 10 to the base 20 includes a first step involving laying the plate 10 on the base 20, the support surface 15 of the plate 10 facing the receiving surface 26 of the base, such that the first 72, second 73, and third 74 rail sections are located next to the first 62, second 63, and third 64 guide rail sections, respectively, i.e., with a longitudinal offset. Next, a second affixing step involves longitudinally displacing, or sliding, the plate 10 with respect to the base 20 to a longitudinally immobilized position, such that the first 72, second 73, and third 74 sections of the rail 61 are slidingly engaged with the first 62, second 63, and third 64 sections, respectively, of the guide rail 60. As a result, the plate 10 and the base 20 are immobilized with respect to one another in all directions, except the longitudinal direction L.

It suffices to organize the longitudinal immobilization to obtain complete attachment of the plate 10 with respect to the base 20. To do so, as can be understood with reference to FIGS. 2, 3, 5, and 6, the invention provides a manually actuated immobilization mechanism to immobilize the plate with respect to the base in the longitudinal guiding direction L.

Because it is actuated by hand, directly and without any tool, the immobilization mechanism enables a simple, easy, and quick assembly or disassembly of the plate 10 in relation to the base 20. Consequently, the retaining device 4 is easily and quickly mounted or dismounted with respect to the ski 3.

Figure 6:
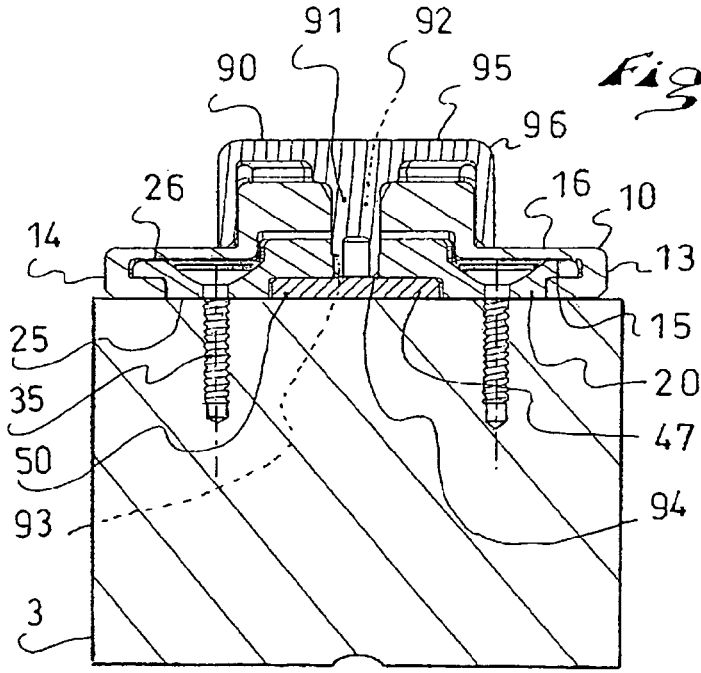
FIG. 6 is cross-section along the line VI-VI of FIG. 3.

According to the first embodiment described, and in a non-limiting manner, and with particular reference to FIG. 6 in conjunction with other figures, the immobilization mechanism includes a first catch 90, carried by the plate 10, which itself includes a first stopping finger 91, and has a first receiving cavity 92 arranged in the plate 10, as well as a first receiving cavity 93 arranged in the base 20. The first finger 91 is partially housed in the cavity 92 of the plate 10, and partially in the cavity 93 of the base 20. Because it extends in both cavities 92, 93, the stopping finger 91 immobilizes the plate 10 with respect to the base 20 along the longitudinal direction L.

The finger 91 extends between a free end 94 and a gripping end 95 of the catch 90. The gripping end, i.e., a manipulable portion of the immobilizing mechanism, i.e., provided to be grabbed by hand, includes a cap having side edges 96.

The finger 91 has a circular cross section. Similarly, the cavities 92, 93 each have a circular cross section. The respective cross sections of the finger 91 and cavities 92, 93 are selected to achieve a precise adjustment, for example one without any play. A resulting advantage is that the plate 10 is maintained longitudinally without play with respect to the base 20. This contributes to steering precision.

The receiving cavity 92 of the plate 10 is in fact a circular hole, which extends transversely from the receiving surface 16 to the support surface 15. The receiving cavity 93 of the base 20 is also a circular hole, which extends transversely from the receiving surface 26 to the support surface 25. The cavities or holes 92, 93 are oriented perpendicular to the support 15, 25 or receiving 16, 26, surfaces, respectively.

The positioning of the finger 91 in the cavities 92, 93 is carried out by hand in a single operation, i.e., by insertion of the side of the receiving surface 16 of the plate 10, after the cavities have been aligned, the plate being in a use position with respect to the base 20, i.e., a position of use for the retaining device 4. As shown in the exemplary embodiment shown in the drawing, movement of the finger 91 to its actuated position is a downward movement with respect to the base and, more specifically, a translational movement perpendicular to the longitudinal, such as vertically downward, with respect to the base.

After the finger 91 has been positioned, the cap 96 covers the plate 10 so as to extend the receiving surface 16 and/or the side edges 13, 14.

The catch 90 is a unitary element made of a plastic material, for example. Alternatively, one could provide for the finger 91 and the end 95 to be attached to one another.

Separating the plate 10 and the base 20 involves manually retracting the catch 90, by mere traction, or pulling, and then longitudinally sliding the plate slightly with respect to the base, and finally spacing them apart.

Generally speaking, the invention is made from materials, and according to implementation techniques, known to one having ordinary skill in the art.

The plate 10 and base 20 can include plastic materials.

The invention is not limited to the embodiment described hereinabove, and includes all of the technical equivalents that fall within the scope of the claims that follow.

In particular, the mechanism for immobilizing the plate with respect to the base can include a plurality of catches.

The longitudinal guiding arrangement can include other elements than a guide rail and a rail.

The guide rail and the rail could be continuous, respectively.

The assembly 1 according to the invention can include all of the elements, including the gliding board, the boot 2, the retaining device 4, the locking mechanism 5, the elastic return mechanism 6, the guiding ridge 7, and the plate 10 and the base 20; or only some of these elements.

The invention claimed is:

1. An assembly comprising:

a plate;

a base;

a device for removably attaching the plate to the base;

the plate being structured and arranged to be associated with a device for removably retaining a boot;

the base being structured and arranged to be associated with a gliding board;

the device for removably attaching the plate to the base comprising an arrangement for guiding the plate with respect to the base along a longitudinal direction; and the device for removably attaching the plate to the base further comprising a tool-less manually actuated immobilization mechanism having a portion structured and arranged for movement perpendicular to the longitudinal direction to an actuated position to immobilize the plate with respect to the base against movement in the longitudinal direction.

2. An assembly according to claim 1, wherein:

the mechanism for longitudinally guiding the plate with respect to the base includes a guide rail and a further rail structured to cooperate in a sliding engagement with the guide rail toward an immobilized position of the plate with respect to the base.

3. An assembly according to claim 2, wherein:

the guide rail is segmented, including a plurality of sections; and the further rail is segmented, including a plurality of sections.

4. An assembly according to claim 2, wherein:

the guide rail is arranged on the plate; and the further rail is arranged on the base.

5. An assembly according to claim 1, wherein:

the immobilization mechanism includes a first catch, said first catch including a first stopping finger, said first stopping finger comprising said portion of the immobilization mechanism;

the immobilization mechanism comprises a first receiving cavity arranged in the plate and a first receiving cavity arranged in the base;

the first stopping finger is partially housed in the first cavity of the plate and partially housed in the first cavity of the base.

6. An assembly according to claim 5, wherein:

the first finger has a circular cross section; and the first cavities each have a circular cross-section.

7. An assembly according to claim 5, wherein:

the first stopping finger extends between a free end and a gripping end of the first catch.

8. An assembly according to claim 1, further comprising:

a device for retaining a boot and a guiding rib for guiding a corresponding groove in the boot.

9. An assembly according to claim 8, wherein:

the retaining device, the rib, and the plate form a unitary element.

10. An assembly according to claim 1, further comprising:

a gliding board.

11. An assembly according to claim 1, further comprising:

a boot.

12. An assembly according to claim 1, further comprising:

a gliding board and a boot.

13. An assembly according to claim 1, wherein:

the device for removably attaching the plate to the base includes no tool not attached to the plate or to the base.

14. An assembly according to claim 1, wherein:

the device for removably attaching the plate to the base includes no screws.

15. An assembly according to claim 1, wherein:

the portion of the tool-less manually actuated immobilization mechanism is a manipulable portion carried by the plate.

16. An assembly according to claim 1, wherein:

the tool-less manually actuated immobilization mechanism is distinct from the device for removably retaining a boot.

17. An assembly according to claim 1, wherein:

said perpendicular movement is a translational movement toward the base.

18. An assembly according to claim 1, wherein:

said perpendicular movement is a vertical movement toward the base.

19. An assembly according to claim 1, wherein:

the arrangement for guiding the plate with respect to the base along a longitudinal direction comprises an arrangement for guiding the plate with respect to the base along the longitudinal direction to a use position for the device for removably retaining the boot; and the perpendicular movement of the portion of the immobilization mechanism to the actuated position is performable after movement of the plate to the use position.

20. An assembly configured and arranged to be mounted upon a ski for removably retaining at least a front of a boot to the ski, said assembly comprising:

a base adapted to be secured upon the ski;

a subassembly comprising:

a plate adapted to be removably attached to the base;

a binding affixed to the plate, said binding removably retaining at least a front of a boot to the ski;

a device for removably attaching said plate of said subassembly to said base when said base is secured upon the ski, said device not including anything not permanently secured either to said subassembly or to said base prior to said plate being attached to said base;

the device for removably attaching said plate to said base comprising:

an arrangement for guiding longitudinal movement of the plate with respect to the base in a direction toward a longitudinally immobilized use position, said arrangement thereby immobilizing the plate with respect to the base except in a longitudinal direction; and a tool-less manually actuated immobilization mechanism for immobilizing the plate with respect to the base after the plate is moved to said longitudinally immobilized use position, said mechanism comprising a portion actuated by a translational movement with respect to the base.

21. An assembly according to claim 20, further comprising:

a plurality of screws for fixing the base to the ski independent of said subassembly being affixed to the ski.

22. An assembly according to claim 21, wherein:

said plate is removably attached to said base without screws.

23. An assembly according to claim 21, wherein:

said plate is removably attached to said base without use of a tool.

24. An assembly according to claim 20, wherein:

said subassembly further comprises an elongated guiding rib adapted for engagement with a longitudinally extending groove in a sole of the boot during use of the ski.

25. An assembly according to claim 20, wherein:

the binding consists of a binding structured and arranged to retain the front of a boot to the ski while allowing a rear of the boot to be raised and lowered relative to the ski.

26. An assembly according to claim 20, wherein:

the binding comprises an actuating lever to removably retain a connecting pin of the boot, said actuating lever being distinct from the device for removably attaching the plate to the base.

27. An assembly according to claim 20, wherein:

the portion of the tool-less manually actuated immobilization mechanism is a manipulable portion carried by the plate.

28. An assembly for mounting a boot on a ski comprising:

a plate having a length adapted to extend from a front to a rear of the boot;

a base for supporting the plate;

a device for removably attaching the plate to the base;

the plate being structured and arranged to be associated with a device for removably retaining a front end of the boot during skiing, allowing a rear of the boot to be raised and lowered relative to the ski;

the base being structured and arranged to be associated with the ski;

the device for removably attaching the plate to the base comprising an arrangement for guiding longitudinally sliding movement of the plate with respect to the base to an immobilization position of the plate with respect to the base;

the device further comprising an immobilization mechanism including a portion structured and arranged to be manipulated and translated in a non-longitudinal direction to immobilize the plate with respect to the base in said immobilization position.

* * * * *